US007547411B2

(12) United States Patent
Bronfin et al.

(10) Patent No.: US 7,547,411 B2
(45) Date of Patent: Jun. 16, 2009

(54) CREEP-RESISTANT MAGNESIUM ALLOY FOR CASTING

(75) Inventors: Boris Bronfin, Beer Sheva (IL); Nir Moscovitch, Beer Sheva (IL); Mark Katzir, Beer Sheva (IL); Soenke Schumann, Schwuelper (DE); Rudolph Boehm, Seelze (DE)

(73) Assignees: Dead Sea manesium Ltd., Beer-Sheva (IL); Volkswagen AG, Woltsburg (DE)

( * ) Notice: Subject to any disclaimer, the term of this patent is extended or adjusted under 35 U.S.C. 154(b) by 0 days.

(21) Appl. No.: 11/805,409

(22) Filed: May 23, 2007

(65) Prior Publication Data

US 2008/0219880 A1 Sep. 11, 2008

(30) Foreign Application Priority Data

Mar. 8, 2007 (IL) ..... 181797

(51) Int. Cl.
*C22C 23/02* (2006.01)

(52) U.S. Cl. ..... 420/410; 420/405

(58) Field of Classification Search ..... 148/406, 148/420, 666, 667; 420/402–414
See application file for complete search history.

(56) References Cited

U.S. PATENT DOCUMENTS

| | | | | |
|---|---|---|---|---|
| 6,139,151 | A | 10/2000 | Ueno et al. | |
| 6,264,763 | B1 | 7/2001 | Powell et al. | |
| 6,322,644 | B1 * | 11/2001 | Pekguleryuz et al. | 148/420 |
| 6,342,180 | B1 | 1/2002 | Lefebvre et al. | |
| 6,808,679 | B2 | 10/2004 | Pekguleryuz et al. | |
| 7,041,179 | B2 | 5/2006 | Bronfin et al. | |
| 2003/0086811 | A1 * | 5/2003 | Bronfin et al. | 420/407 |

FOREIGN PATENT DOCUMENTS

| | | |
|---|---|---|
| EP | 1127950 | 8/2001 |
| EP | 1418247 | 5/2004 |
| EP | 1308530 | 5/2006 |
| WO | WO 01/25653 A1 | 4/2001 |
| WO | 01/44529 | 6/2001 |
| WO | 03/046239 | 6/2003 |

* cited by examiner

*Primary Examiner*—George Wyszomierski
*Assistant Examiner*—Mark L Shevin
(74) *Attorney, Agent, or Firm*—Kinney & Lange, P.A.

(57) ABSTRACT

Magnesium-based alloys are provided which exhibit improved resistance to creeping and to corrosion, as well as improved strength, and good castability. The alloys are suitable for applications at both ambient and elevated temperatures.

12 Claims, 6 Drawing Sheets

Table 1. Chemical Compositions of Alloys

| Alloy | Al % | Mn % | Zn % | Sr % | RE % | Ca % | Si % | Fe % | Ni % | Cu % | Be % |
|---|---|---|---|---|---|---|---|---|---|---|---|
| Example1 | 5.7 | 0.24 | - | 1.75 | 0.55 | - | 0.02 | 0.003 | 0.0007 | 0.0005 | 0.0009 |
| Example2 | 6.1 | 0.23 | - | 2.4 | 0.40 | 0.05 | 0.01 | 0.003 | 0.0006 | 0.0014 | 0.0004 |
| Example3 | 6.5 | 0.22 | 0.15 | 2.7 | 0.22 | - | 0.35 | 0.003 | 0.0008 | 0.0012 | 0.0007 |
| Example4 | 6.3 | 0.23 | 0.05 | 2.5 | 0.35 | - | 0.25 | 0.002 | 0.0005 | 0.0011 | 0.0005 |
| Example5 | 6.9 | 0.22 | - | 2.9 | 0.85 | 0.38 | 0.01 | 0.003 | 0.0008 | 0.0011 | 0.0004 |
| Example6 | 7.4 | 0.21 | - | 3.3 | 0.60 | - | 0.01 | 0.002 | 0.0007 | 0.0008 | 0.0005 |
| Example7 | 7.2 | 0.22 | 0.10 | 2.3 | 0.75 | 0.37 | 0.01 | 0.003 | 0.0009 | 0.0011 | 0.0003 |
| Example8 | 6.2 | 0.23 | - | 2.4 | 0.80 | 0.08 | 0.01 | 0.002 | 0.0008 | 0.0016 | 0.0004 |
| Comparative Example 1 | 6.1 | 0.29 | - | 2.4 | - | - | 0.01 | 0.003 | 0.0009 | 0.0009 | 0.0009 |
| Comparative Example 2 | 4.9 | 0.32 | 0.01 | 1.9 | - | - | 0.01 | 0.003 | 0.0008 | 0.0008 | 0.0008 |
| Comparative Example 3 | 5.5 | 0.26 | 0.02 | 1.95 | 0.4 | 0.35 | 0.007 | 0.004 | 0.0006 | 0.0011 | 0.0009 |
| Comparative Example 4 | 7.9 | 0.25 | 0.20 | 2.5 | 0.34 | - | 0.01 | 0.003 | 0.0008 | 0.0012 | 0.0007 |
| Comparative Example 5 | 6.4 | 0.24 | - | 1.6 | 1.2 | 0.55 | 0.65 | 0.003 | 0.0009 | 0.0015 | 0.0004 |

Table 1. Chemical Compositions of Alloys

| Alloy | Al % | Mn % | Zn % | Sr % | RE % | Ca % | Si % | Fe % | Ni % | Cu % | Be % |
|---|---|---|---|---|---|---|---|---|---|---|---|
| Example1 | 5.7 | 0.24 | - | 1.75 | 0.55 | - | 0.02 | 0.003 | 0.0007 | 0.0005 | 0.0009 |
| Example2 | 6.1 | 0.23 | - | 2.4 | 0.40 | 0.05 | 0.01 | 0.003 | 0.0006 | 0.0014 | 0.0004 |
| Example3 | 6.5 | 0.22 | 0.15 | 2.7 | 0.22 | - | 0.35 | 0.003 | 0.0008 | 0.0012 | 0.0007 |
| Example4 | 6.3 | 0.23 | 0.05 | 2.5 | 0.35 | - | 0.25 | 0.002 | 0.0005 | 0.0011 | 0.0005 |
| Example5 | 6.9 | 0.22 | - | 2.9 | 0.85 | 0.38 | 0.01 | 0.003 | 0.0008 | 0.0011 | 0.0004 |
| Example6 | 7.4 | 0.21 | - | 3.3 | 0.60 | - | 0.01 | 0.002 | 0.0007 | 0.0008 | 0.0005 |
| Example7 | 7.2 | 0.22 | 0.10 | 2.3 | 0.75 | 0.37 | 0.01 | 0.003 | 0.0009 | 0.0011 | 0.0003 |
| Example8 | 6.2 | 0.23 | - | 2.4 | 0.80 | 0.08 | 0.01 | 0.002 | 0.0008 | 0.0016 | 0.0004 |
| Comparative Example 1 | 6.1 | 0.29 | - | 2.4 | - | - | 0.01 | 0.003 | 0.0009 | 0.0009 | 0.0009 |
| Comparative Example 2 | 4.9 | 0.32 | 0.01 | 1.9 | - | - | 0.01 | 0.003 | 0.0008 | 0.0008 | 0.0008 |
| Comparative Example 3 | 5.5 | 0.26 | 0.02 | 1.95 | 0.4 | 0.35 | 0.007 | 0.004 | 0.0006 | 0.0011 | 0.0009 |
| Comparative Example 4 | 7.9 | 0.25 | 0.20 | 2.5 | 0.34 | - | 0.01 | 0.003 | 0.0008 | 0.0012 | 0.0007 |
| Comparative Example 5 | 6.4 | 0.24 | - | 1.6 | 1.2 | 0.55 | 0.65 | 0.003 | 0.0009 | 0.0015 | 0.0004 |

Fig. 1

Table 2. Phase Compositions of New Alloys

| Alloy | Phase Composition |
|---|---|
| Example 1 | $Mg\text{-}Al_{ss}$; $Al_2(Sr, RE)_1$; $Al_x(Mn, RE)_y$ |
| Example 2 | $Mg\text{-}Al_{ss}$; $Al_2Sr$; $Al_x(Mn,RE)_y$ |
| Example 3 | $Mg\text{-}Al_{ss}$; $Al_2Sr$; $Al_2(Sr, RE)_1$; $Al_y(Mn,RE)_y$; $Mn_5(Si,RE)_3$ |
| Example 4 | $Mg\text{-}Al_{ss}$; $Al_2Sr$, $Al_2$; $(Sr, RE)_1$; $Al_y(Mn,RE)_y$; $Mn_5(Si,RE)_3$ |
| Example 5 | $Mg\text{-}Al_{ss}$; $Al_2(Sr,Ca)_1$; $Al_2(Sr, RE)_1$; $Al_y(Mn,RE)_y$ |
| Example 6 | $Mg\text{-}Al_{ss}$; $Al_2Sr$; $Al_2(Sr, RE)_1$; $Al_y(Mn,RE)_y$ |
| Example 7 | $Mg\text{-}Al_{ss}$; $Al_2(Sr,Ca)_1$; $Al_2(Sr, RE)_1$; $Al_y(Mn,RE)_y$ |
| Example 8 | $Mg\text{-}Al_{ss}$; $Al_2(Sr,Ca)_1$; $Al_2(Sr, RE)_1$; $Al_y(Mn,RE)_y$ |
| Comparative example 1 | $Mg\text{-}Al_{ss}$; $Al_4Sr$; $Al_8Mn_5$ |
| Comparative example 2 | $Mg\text{-}Al_{ss}$,; $Al_4Sr$; $Al_3Mg_{13}Sr$, $Al_8Mn_5$ |
| Comparative example 3 | $Mg\text{-}Al_{ss}$; $Al_2(Sr,Ca)_1$, $Al_3Mg_{13}Sr$ $Al_y(Mn,RE)_y$ |
| Comparative example 4 | $Mg\text{-}Al_{ss}$; $Mg_{17}(Al,Sr,Zn)_{12}$, $Al_8(Mn,RE)_5$, $(Al, Zn)_2Sr$ |
| Comparative example 5 | $Mg\text{-}Al_{ss}$; $Al_2(Sr,Ca)_1$; $Al_{11}(RE,Ca)_3$; $Al_8(Mn,RE)_5$, $Mg_2Si$ |

Fig. 2

Table 3. Die Castability Properties

| Alloy | Casting Temperature [°C] | Oxidation Resistance | Fluidity | Die Sticking | Castability Rank |
|---|---|---|---|---|---|
| Example 1 | 690 | 10 | 9 | 9.5 | 95 |
| Example 2 | 690 | 10 | 9 | 10 | 99 |
| Example 3 | 680 | 10 | 10 | 9.5 | 96 |
| Example 4 | 690 | 10 | 9 | 9.5 | 95 |
| Example 5 | 690 | 10 | 9.5 | 10 | 99 |
| Example 6 | 690 | 10 | 10 | 9 | 93 |
| Example 7 | 690 | 10 | 10 | 9.5 | 97 |
| Example 8 | 690 | 10 | 9 | 9.5 | 95 |
| Comparative Example 1 | 700 | 9.5 | 9 | 9 | 91 |
| Comparative Example 2 | 720 | 9 | 8 | 9 | 87 |
| Comparative Example 3 | 710 | 10 | 9 | 8.5 | 87 |
| Comparative Example 4 | 690 | 10 | 10 | 8 | 86 |
| Comparative Example 5 | 700 | 10 | 8 | 7 | 77 |

Fig. 3

Table 4. Mechanical Properties

| Alloy | TYS [MPa] | | UTS [ MPa] | | E % | CYS [MPa] | | Shear Strength [MPa] | HB |
|---|---|---|---|---|---|---|---|---|---|
| | 20°C | 150°C | 20°C | 150°C | 20°C | 20°C | 150°C | 20°C | 20°C |
| Example 1 | 145 | 112 | 235 | 170 | 8 | 144 | 115 | 130 | 62 |
| Example 2 | 150 | 115 | 240 | 173 | 8 | 147 | 113 | 135 | 63 |
| Example 3 | 154 | 116 | 245 | 170 | 9 | 152 | 115 | 138 | 65 |
| Example 4 | 155 | 120 | 240 | 168 | 9 | 154 | 118 | 140 | 64 |
| Example 5 | 160 | 125 | 245 | 173 | 8 | 158 | 124 | 145 | 64 |
| Example 6 | 168 | 120 | 245 | 177 | 7 | 164 | 122 | 144 | 65 |
| Example 7 | 170 | 122 | 243 | 180 | 6 | 165 | 119 | 148 | 63 |
| Example 8 | 150 | 117 | 260 | 172 | 9 | 146 | 115 | 136 | 69 |
| Comparative Example 1 | 140 | 105 | 230 | 160 | 7 | 135 | 98 | 120 | 61 |
| Comparative Example 2 | 137 | 108 | 220 | 150 | 7 | 139 | 101 | 115 | 60 |
| Comparative Example 3 | 145 | 118 | 225 | 165 | 6 | 142 | 113 | 122 | 61 |
| Comparative Example 4 | 149 | 110 | 234 | 169 | 4 | 144 | 112 | 124 | 62 |
| Comparative Example 5 | 140 | 112 | 238 | 168 | 7 | 138 | 108 | 118 | 61 |

Fig. 4

Table 5. Creep, Corrosion and Fatigue Properties

| Alloy | MCR·$10^{-9}$ [$s^{-1}$] | | Corrosion Rate [mils/year] | Fatigue Strength [MPa] |
|---|---|---|---|---|
| | 150°C 70 MPa | 175°C 50 MPa | 20°C | 20°C |
| Example 1 | 0.51 | 0.43 | 0.64 | 150 |
| Example 2 | 0.49 | 0.38 | 0.63 | 155 |
| Example 3 | 0.34 | 0.29 | 0.69 | 157 |
| Example 4 | 0.35 | 0.31 | 0.65 | 155 |
| Example 5 | 0.39 | 0.34 | 0.59 | 155 |
| Example 6 | 0.32 | 0.28 | 0.64 | 153 |
| Example 7 | 0.33 | 0.27 | 0.49 | 150 |
| Example 8 | 0.38 | 0.32 | 0.62 | 160 |
| Comparative Example 1 | 0.94 | 0.76 | 0.87 | 140 |
| Comparative Example 2 | 0.82 | 0.59 | 1.03 | 135 |
| Comparative Example 3 | 0.71 | 0.55 | 1.24 | 138 |
| Comparative Example 4 | 1.24 | 1.15 | 1.18 | 144 |
| Comparative Example 5 | 0.96 | 0.78 | 0.98 | 142 |

Fig. 5

Table 6. Bolt Load Retention Properties

| Alloy | Retained Stress, % | |
|---|---|---|
| | 150°C / 70 MPa | 175 °C / 70 MPa |
| Example 1 | 55 | 51 |
| Example 2 | 57 | 52 |
| Example 3 | 54 | 49 |
| Example 4 | 58 | 52 |
| Example 5 | 56 | 50 |
| Example 6 | 59 | 52 |
| Example 7 | 55 | 49 |
| Example 8 | 53 | 47 |
| Comparative Example 1 | 43 | 39 |
| Comparative Example 2 | 46 | 41 |
| Comparative Example 3 | 47 | 42 |
| Comparative Example 4 | 43 | 38 |
| Comparative Example 5 | 48 | 44 |

Fig. 6

CREEP-RESISTANT MAGNESIUM ALLOY FOR CASTING

CROSS-REFERENCE TO RELATED APPLICATION(S)

This application claims priority of Israel Patent Application No. 181797 filed Mar. 8, 2007.

TECHNICAL FIELD

The present invention generally relates to magnesium based alloys and more particularly aims at providing casting magnesium alloys with improved creep and corrosion resistance. The alloys of the present invention can be used in thixoforming, squeeze casting, permanent mold casting, sand casting, investment casting, and, particularly, in high-pressure die casting.

BACKGROUND

The light structural materials, such as magnesium alloys, are attractive for applications including the transportation industry, power tools, sporting goods, and computer and electronic products. The magnesium components have better strength-to-weight ratio than their aluminum or steel counterparts, thereby reducing the total vehicle weight and loading and improving fuel economy, while also increasing safety, significantly lowering emissions, and increasing recyclability. Although various casting processes are used to produce magnesium alloy parts, around 90% of cast magnesium components are produced by high-pressure die casting process. Other relevant production technologies include sand casting, permanent mold and investment casting, as well as squeeze casting, and varies types of semi-solid casting technologies. All commercial high-pressure die casting magnesium alloys are based on Mg—Al—Mn system with additions of Zn, Si, or rare earth elements (RE).

Die casting magnesium alloys of Mg—Al—Mn system, such as AM50A and AM60B, and of Mg—Al—Zn system, such as AZ91D, exhibit good castability, good corrosion resistance, and combination of ambient strength and ductility; however, they exhibit poor elevated temperature strength, poor creep resistance, and poor bolt load retention capability.

On the other hand, Mg—Al—Si alloys, such as AS41, AS31 and AS21, and Mg—Al—Re alloys, such as AE42, AE43 and AE44, exhibit improved creep resistance but reveal inadequate corrosion performance (Mg—Al—Si alloys) or poor castability (AE42 and AE43 alloys). In addition, both AS and AE alloy-series exhibit relatively low tensile yield strength and fatigue strength at room temperature.

Recently several creep-resistant magnesium alloys were developed and described, for example in U.S. Pat. No. 6,139,151, EP 1,135,630, EP 1,127,950, U.S. Pat. Nos. 6,342,180, 6,264,763 and 7,041,179. These alloys are based on Mg—Al system with addition of Ca or Ca+RE as the main alloying elements to increase creep resistance. On the other hand, another alkaline-earth element, Sr, was mainly used as a minor ingredient for addition to Mg—Al—Ca or Mg—Al—Ca—Re systems.

Another approach was recently demonstrated in U.S. Pat. Nos. 6,322,644 and 6,808,679 that describe magnesium based alloys, which contain 2 to 9 wt % aluminum, 0.5 to 7 wt % strontium, 0 to 0.35 wt % zinc and 0.0 to 0.60 wt % manganese.

EP 1418247 discloses a magnesium based alloy for high-pressure die casting containing 4.0 to 9.0 wt % aluminum, 0.5 to 4 wt % strontium, and 0.03 to 2.5 wt % barium. The alloy exhibits an adequate creep resistance, but barium is considered as a very toxic element, and its use is undesirable.

It is an object of this invention to provide magnesium-based alloys being suitable for high temperature applications, and having good corrosion resistance.

It is another object of this invention to provide alloys which are particularly well adapted for high-pressure die casting process, and which exhibit improved castability.

It is a further object of this invention to provide alloys which may also be used for other applications, such as thixoforming, sand casting, permanent mold casting, and squeeze casting.

It is a still further object of this invention to provide alloys, which are not prone to die sticking and hot cracking.

It is a still further object of this invention to provide alloys with improved strength at ambient and elevated temperatures, as well as with improved creep resistance at elevated temperatures up to at least 175° C.

It is a still further object of this invention to provide alloys which demonstrate the aforesaid behavior and properties, and also have a relatively low cost.

Other objects and advantages of present invention will appear as description proceeds.

SUMMARY

The present invention provides a magnesium based alloy comprising at least 87 wt % magnesium (Mg), from 5.7 to 7.5 wt % aluminum (Al), from 0.18 to 0.35 wt % manganese (Mn), from 1.7 to 3.5 wt % strontium (Sr), from 0.3 to 0.9 wt % rare earth elements (RE), from 0.0003 to 0.0015 wt % beryllium (Be), from 0.0 to 0.4 wt % calcium (Ca), 0.0 to 0.5 wt % silicon (Si), and from 0.0 to 0.15 wt % zinc (Zn). The alloys of the invention may comprise incidental impurities. Said alloys may comprise up to 0.004 wt % iron, up to 0.001 wt % nickel, and up to 0.003 wt % copper. In a preferred embodiment of the invention, a magnesium alloy comprises from 6.1 to 7.4 wt % Al, from 2.4 to 3.3 wt % Sr, and from 0.35 to 0.85 wt % RE.

The invention is directed to an article produced by casting a magnesium alloy comprising at least 87 wt % Mg, 5.7 to 7.5 wt % Al, 0.18 to 0.35 wt % Mn, 1.7 to 3.5 wt % Sr, 0.3 to 0.9 wt % RE, 0.0 to 0.4 wt % Ca, 0.0 to 0.5 wt % Si, and 0.0 to 0.15 wt % Zn. Said casting is preferably high-pressure die casting. Said casting may be also sand casting, permanent mold casting, squeeze casting, semi-solid casting, thixoforming, and investment casting.

The alloy of the invention has a superior resistance to creeping at ambient and elevated temperatures, and combines good castability with high tensile yield strength and compressive yield strength both at ambient and elevated temperatures.

Alloying with strontium, rare earth elements, and calcium leads to the formation of stable intermetallics at grain boundaries of Mg—Al solid solution. The high melting point of these intermetallic phases contributes to their high stability at elevated temperatures, resulting in superior mechanical properties at temperatures of up to at least 175° C. The alloys of the present invention further exhibit excellent castability and are not prone to die sticking and soldering.

An alloy according to the invention exhibits high resistance to creeping at ambient and elevated temperatures, their minimum creep rate (MCR) being typically about $0.50\times1^{-9}$/s or less at 150° C. under the stress of 70 MPa, and typically about $0.45\times10^{-9}$/s or less at 175° C. under the stress of 50 MPa, said MCR values being preferably less than $0.50\times10^{-9}$/s and more preferably less than $0.40\times10^{-9}$/s.

An alloy according to the invention exhibits good strength at both ambient and elevated temperatures. Ultimate tensile strength (UTS) of the alloys is typically 235 MPa or more at ambient temperature and typically about 170 MPa or more at 150° C., said UTS values being preferably 240 MPa or more at ambient temperature and 170 or more at 150° C. Tensile yield strength (TYS) of the alloys is typically about 145 MPa or more at ambient temperature and typically about 115 MPa or more at 150° C., said TYS values being preferably 150 MPa or more at ambient temperature and 115 or more at 150° C. Compressive yield strength (CYS) of the alloys is typically about 145 MPa or more at ambient temperature and typically about 113 MPa or more at 150° C., said CYS values being preferably 145 MPa or more at ambient temperature and 115 or more at 150° C. The alloys show also good shear strength. The alloys according to the invention combine the good creeping behavior and good strength with good corrosion properties and fatigue properties, as well as with good bolt load retention properties, and, importantly also with good castability.

BRIEF DESCRIPTION OF THE DRAWINGS

The above and other characteristics and advantages of the invention will be more readily apparent through the following examples, and with reference to the appended tables, wherein:

FIG. 1 is Table 1, showing chemical compositions of alloys according to the invention and of comparative alloys;

FIG. 2 is Table 2, showing intermetallic phases in the alloys;

FIG. 3 is Table 3, showing the castability properties of the alloys;

FIG. 4 is Table 4, showing the mechanical properties of the alloys;

FIG. 5 is Table 5, showing the creep properties, corrosion and fatigue properties of the alloys; and FIG. 6 is Table 6, showing the bolt load retention properties of the alloys.

DETAILED DESCRIPTION

Magnesium-based casting alloys, which have chemical compositions according to the present invention, as noted hereinbefore outperform the prior art alloys in mechanical, technological, and corrosion properties. These properties include excellent molten metal behavior and castability combined with improved tensile, compressive, shear and fatigue strength, and as well as excellent corrosion and creep resistance, and bolt load retention properties.

The alloys of the present invention contain aluminum, strontium, rare earth elements, and manganese. As discussed below they may also contain other elements as additional ingredients, or incidental impurities.

The magnesium-based alloy of the present invention comprises 5.7 to 7.5 wt % aluminum. If the aluminum concentration is less than 5.7 wt %, the alloy will exhibit poor castability properties, particularly low fluidity and tendency to die-sticking. On the other hand, aluminum concentration higher than 7.5 wt % leads to significant deterioration in ductility, creep resistance and bolt load retention properties.

The preferred range for strontium is 1.7 to 3.5 wt %. Strontium is bound to aluminum with formation of stable intermetallic compounds that impede grain sliding. In addition, this also results in suppressing the formation of the β-phase, $Mg_{17}Al_{12}$, intermetallic compounds. Both these factors contribute to improved creep resistance. Adding of Sr in amounts less than 1.7% does not provide a sufficient creep resistance, and also leads to the deterioration of castability. On the other hand, the strontium content should not exceed 3.5% in order to avoid a sharp decrease in ductility, and increased sticking, of the castings in the die, followed by soldering and hot cracking. In addition, the use of higher Sr content is uneconomical.

The alloys of this invention also contain 0.3 to 0.9 wt % of rare earth elements preferably in the form of Ce— or La-based mishmetal. Rare earth elements modify the precipitated intermetallics, improve their morphology and increase stability. In addition the presence of rare earth elements improves corrosion resistance. The use of RE elements also allows to reduce Mn content to be introduced in the alloy for maintaining Fe content lower then 0.004%. This leads to minimizing concentration of hard insoluble Al—Mn particles that are detrimental for shot sleeve of die casting machine, and during subsequent machining operations to be done on the die cast parts. The alloying with less than 0.3 wt % rare earth elements is ineffective and does not provide marked improvement of the properties either at room or at elevated temperatures. On the other hand, adding of RE elements in the amount greater than 0.9% may lead to embrittlement and deterioration of castability. Beryllium is added into alloys of this invention in an amount of 0.0003 to 0.0015 wt % in order to prevent burning, and to reduce dross and sludge formation.

The alloys of present invention may contain 0.0 to 0.4 wt % Ca in order to improve oxidation resistance, molten metal handling and creep behavior. However, Ca content higher than 0.4 wt % results in strong sticking in the die, and soldering phenomena.

The alloys of the present invention contain minimal amounts of iron, copper and nickel, to maintain a low corrosion rate. There is preferably less than 0.004 wt % iron, and more preferably less than 0.003 wt % iron. A low iron content can be obtained by adding manganese. The iron content of less than 0.003 wt % can be achieved at minimal residual manganese content 0.17 wt % in the alloy. Adding Mn in amounts higher than 0.35 wt % leads to excessive sludge formation at subsequent remelting prior to the high-pressure die casting process. Zn may be added optionally to further improve fluidity, but not higher then 0.15 wt %. Adding Zn in higher concentration can lead to the deterioration of creep properties, and to the increased susceptibility to sticking in the die.

It has been found that the addition of strontium, rare earth elements, manganese, calcium and zinc in the weight percentages set forth herein gives rise to the formation of several intermetallic phases. Intermetallic compounds $Al_2(Sr,RE)_1$, $Al_2Sr$, $Al_2(Sr,Ca,)_1$ and $Al_y(Mn,RE)_y$ were revealed in grain boundaries of the matrix Mg—Al solid solution ($Mg—Al_{SS}$).

The magnesium alloys of the instant invention exhibit high shear, high tensile and compressive yield strength at room and elevated temperatures, combined with good creep resistance, bolt load retention properties, and fatigue strength. They also have excellent castability and corrosion resistance.

The invention will be further described and illustrated in the following examples.

EXAMPLES

General Procedures

The alloys of the present invention were prepared in 100 liter crucible made of low carbon steel. During melting and holding, the melt was protected under a gas mixture of $CO_2$+ 0.5% $SF_6$. The alloying ingredients used were as follows:

Magnesium—pure magnesium, grade 9980A, containing at least 99.8% Mg.

Manganese—an Al-60% Mn master alloy that was added into the molten magnesium at a melt temperature from 700° C. to 720° C., depending on the manganese concentration. Special preparation of the charged pieces and intensive stirring of the melt for 15-30 min have been used to accelerate manganese dissolution in the molten magnesium.

Aluminum—commercially pure Al containing less than 0.2% impurities.

Strontium—a master alloy Al-90% Sr.

Rare earth elements—a cerium based mishmetal comprising 50% Ce+25% La+20% Nd+5% Pr.

Calcium—a master alloy Al-75% Ca.

Zinc—commercially pure Zn containing less than 0.1% impurities.

Typical temperatures for alloying with Al, Sr, RE, Ca, and Zn were from 690° C. to 710° C. Intensive stirring for 2-15 min was sufficient for dissolving these elements in the molten magnesium.

Beryllium—3-15 ppm of beryllium were introduced into the new alloys in the form of a master alloy Al-1% Be, after settling the melt at temperatures of 660-690° C. prior to casting.

After obtaining the compositions required the alloys were cast into the 8 kg ingots. Neither burning nor oxidation was observed on the surface of all the experimental ingots.

Chemical analysis was performed using spark emission spectrometer.

The die casting trials were performed using an IDRA OL-320 cold chamber die casting machine with a 345 ton locking force. The die castability was evaluated over high-pressure die casting trials based on observed fluidity, oxidation resistance and die sticking or soldering. A rating from 1 to 10 ('1' representing the worst and '10' representing the best) was given to each alloy with regard to three of the above properties. In addition, the weight factor '4' was given to "die sticking/soldering tendency" and weight factor '1' was given to two other characteristics.

Quantitatively the die castability was evaluated by equation:

$$\text{Castability index} = \frac{T}{670} \cdot \text{OR} + \frac{670}{T} \cdot F + 4S\frac{5}{3}$$

where T is actual casting temperature [° C.];

670—is casting temperature for AZ91D alloy [° C.], which is considered as a benchmark alloy in terms of castability performance;

OR—is oxidation resistance; and

S—is tendency to die sticking/soldering.

Metallographic examination was performed using an optical microscope and scanning electron microscope (SEM) equipped with an energy dispersive spectrometer (EDS).

The phase compositions were determined using X-Ray diffraction analysis combined with EDS analysis.

Tensile and compression testings at ambient and elevated temperatures were performed using an Instron 4483 machine equipped with an elevated temperature chamber according to ASTM standards B557M and E21. Tensile yield strength (TYS), Ultimate Tensile Strength (UTS), percent elongation (%E), and Compression Yield Strength (CYS) were determined.

The Shear Strength was determined in accordance with ASTM B565 using cylindrical samples with a 6 mm diameter excised from the gage area of tensile samples.

The SATEC rotating beam testing machine was used for the determination of the fatigue strength for $10^8$ cycles at R=−1. The samples with a continuous radius between ends having a 6 mm diameter of reduced section and a 9.45 mm head diameter were used. The SATEC Model M-3 machine was used for creep testing. Creep tests were performed at 150° C. and 175° C. for 200 hrs under a stress of 50 MPa and 70 MPa respectively. These conditions were selected based on creep behavior requirements for power train components like transfer case, oil pan, bedplate, oil pump, etc. Creep resistance was estimated based on the value of the minimum creep rate, which is considered as the most important design parameter for power train components.

In addition, bolt load retention was measured. This parameter is used to simulate the relaxation that may occur in service conditions under a compressive loading. The cylindrical samples with outside diameter of 17 mm containing whole with a 10 mm diameter and having height of 18 mm were used. These specimens were loaded to certain stress using hardened 440C stainless still washers and a high strength M8 bolt instrumented with strain gages. The change in load over 200 h at 150° C. and 175° C. was measured continuously. The ratio of two loads, namely the load at the completion of the test after returning to ambient condition to the initial load at room temperature is a measure of the bolt load retention behavior of an alloy.

Corrosion performance was evaluated by SAE J2334 cyclic corrosion test which is considered as showing the best correlation with car exploitation conditions.

According to the above standard, each cycle required a 6-hr dwell in 100% RH atmosphere at 50° C., a 17.4-hr dry stage in 50% RH atmosphere at 60° C. Between the main stages a 15-min dip in an aqueous solution (0.5% NaCl, 0.1% $CaCl_2$, 0.07% $NaHCO_3$ was performed. At weekends and holidays the test was ran on the dry mode. The test duration was 80 cycles that corresponds to 5 years of car exploitation. The specimens used were plates with dimensions of 140×100×3 mm. The samples were degreased in acetone and weighed prior to the immersion in the test solution. Five replicates of each alloy were tested. At the end of the test, the corrosion products were stripped in a chromic acid solution (180 g $CrO_3$ per liter solution) at 80° C. about three minutes and the weight loss was determined. Then the weight loss was used to calculate the average corrosion rate in mils per year (MPY) over the 80 days period.

EXAMPLES OF ALLOYS

Tables 1 to 4 demonstrate chemical compositions and properties of alloys according to the invention and alloys of comparative examples. Table 1 shows chemical compositions of 8 novel alloys along with 5 comparative examples.

The results of an X-Ray diffraction analysis and EDS analysis are shown in table 2 along with data obtained for comparative examples. As can be seen from Table 2, alloying with aluminum, strontium, rare earth elements, manganese, calcium and zinc results in the formation of new precipitates that are different from the intermetallics, which are precipitated in the comparative alloys.

Die castability properties of the novel alloys are presented in Table 3. It is evident that the novel alloys of the present invention outperform the alloys of Comparative Examples in the die castability index.

The tensile, compression and shear properties of new alloys are compared in Table 4 with the values for the comparative alloys. The alloys of the present invention exhibit higher Tensile Yield Strength (TYS), Ultimate Tensile Strength, and Compressive Yield Strength (CYS) both at ambient temperature and at 150° C. In addition, Shear Strength and Brinell hardness HB of novel alloys is also higher than that of comparative alloys.

Corrosion resistance and rotating beam fatigue properties are also better in the new alloys than in the alloys of Comparative Examples (Table 5), as well as bolt load retention properties (Table 6). As can be seen from Tables 4, 5, and 6 the alloys of the present invention are superior to the comparative alloys at both ambient and elevated temperatures.

Although the present invention has been described with reference to preferred embodiments, workers skilled in the art will recognize that changes may be made in form and detail without departing from the spirit and scope of the invention.

The invention claimed is:

1. A magnesium based alloy for die casting, creep-resistant and not prone to die sticking, comprising:

i) at least 87 wt % magnesium (Mg);

ii) 6.1 to 7.4 wt % aluminum (Al);

iii) 1.7 to 3.5 wt % strontium (Sr);

iv) 0.35 to 0.85 wt % rare earth elements (RE);

v) 0.18 to 0.35 wt % manganese (Mn);

vi) 0.0003 to 0.0015 wt % beryllium (Be);

vii) 0.0 to 0.5 wt % silicon (Si);

viii) 0.0 to 0.4 wt % calcium (Ca); and ix) 0.0 to 0.15 wt % zinc (Zn);

wherein the alloy has a minimum creep rate (MCR) at 150° C. and under the stress of 70 MPa of about $0.5\times10^{-9}$/s or less, in combination with tensile yield strength (TYS) at 150° C. of about 115 MPa or more and at ambient temperature of about 145 MPa or more.

2. An alloy according to claim 1, further comprising incidental impurities.

3. An alloy according to claim 2, comprising up to 0.004 wt % iron, up to 0.001 wt % nickel, and up to 0.003 wt % copper.

4. An article produced by casting a magnesium alloy according to claim 1.

5. An article according to claim 4, wherein the casting is high-pressure die casting.

6. An article according to claim 4, wherein the casting is selected from the group consisting of sand casting, permanent mold casting, squeeze casting, semi-solid casting, thixoforming, and investment casting.

7. An alloy according to claim 1, exhibiting high resistance to creeping at ambient and elevated temperatures.

8. An alloy according to claim 1, exhibiting high tensile yield strength, ultimate tensile strength and compressive yield strength both at ambient and elevated temperatures.

9. An alloy according to claim 1, exhibiting high shear strength and fatigue strength.

10. An alloy according to claim 1, exhibiting high resistance to corrosion.

11. An alloy according to claim 1, exhibiting good castability.

12. An alloy according to claim 1, wherein the calcium (Ca) content is 0.0 wt %.

* * * * *

UNITED STATES PATENT AND TRADEMARK OFFICE

CERTIFICATE OF CORRECTION

PATENT NO. : 7,547,411 B2
APPLICATION NO. : 11/805409
DATED : June 16, 2009
INVENTOR(S) : Boris Bronfin et al.

It is certified that error appears in the above-identified patent and that said Letters Patent is hereby corrected as shown below:

On the Title Page, Item (73)
In the Assignees, delete "Dead Sea manesium Ltd." and insert --Dead Sea Magnesium Ltd.--.

Signed and Sealed this

Twenty-seventh Day of July, 2010

David J. Kappos

David J. Kappos
*Director of the United States Patent and Trademark Office*